United States Patent [19]

Shaffer et al.

[11] Patent Number: 4,590,771

[45] Date of Patent: May 27, 1986

[54] CONTROL SYSTEM FOR DEFROSTING THE OUTDOOR COIL OF A HEAT PUMP

[75] Inventors: Jacob E. Shaffer, York; Wayne D. Dellinger, Windsor; James R. Harnish, York, all of Pa.

[73] Assignee: Borg-Warner Corporation, Chicago, Ill.

[21] Appl. No.: 736,899

[22] Filed: May 22, 1985

[51] Int. Cl.[4] ..... F25D 21/06

[52] U.S. Cl. ..... 62/156; 62/155

[58] Field of Search ..... 62/156, 155, 234, 151, 62/140, 126, 128

[56] References Cited

U.S. PATENT DOCUMENTS

| | | | |
|---|---|---|---|
| 4,302,947 | 12/1981 | Mueller et al. | 62/155 |
| 4,328,680 | 5/1982 | Stamp et al. | 62/155 |
| 4,338,790 | 7/1982 | Saunders et al. | 62/80 |
| 4,373,349 | 2/1983 | Mueller | 62/156 |
| 4,417,452 | 11/1983 | Ruminsky et al. | 62/155 |
| 4,474,024 | 10/1984 | Eplett et al. | 62/140 |

*Primary Examiner*—Harry B. Tanner

*Attorney, Agent, or Firm*—James E. Tracy

[57] ABSTRACT

By sensing the outdoor ambient temperature and the outdoor coil temperature in a heat pump when the outdoor coil is frost-free, a control system determines the split or difference that will later exist between those temperatures (the coil temperature drops as frost accumulates) when sufficient frost has built up on the outdoor coil to necessitate defrosting. When that defrost temperature split, called the Normal Defrost Value or NDV, is exceeded, defrost is initiated and the coil will be defrosted. Since the amount of frost that may have already accumulated on the coil is unknown when the control system is initially powered up (such as when power is restored after an outage), the control system calculates, from the current outdoor ambient temperature, an assumed value for the coil temperature which is likely to exist if the coil were frost-free. The first NDV determined after power up is based on the assumed coil temperature. As a safety feature to prevent damage to the heat pump, a Default Defrost Value (DDV), which is the maximum temperature split that will be allowed between the outdoor ambient temperature and the coil temperature, is calculated based on the current outdoor temperature. If the coil temperature ever drops below the outdoor temperature to an extent greater than the DDV, the outdoor coil is defrosted. If two successive default defrosts are requested within one hour, the heat pump's compressor is turned off and locked out.

9 Claims, 3 Drawing Figures

CONTROL SYSTEM FOR DEFROSTING THE OUTDOOR COIL OF A HEAT PUMP

BACKGROUND OF THE INVENTION

This invention relates to a defrost control system, for the outdoor coil of a heat pump, which optimizes efficiency and conserves energy during normal running operation and particularly during the period following system power up.

When a heat pump operates in its heating mode, frost builds up on the pump's outdoor coil and forms an insulating layer between the coil, through which refrigerant flows, and the outdoor air which flows over the coil. As the frost thickness increases, heat transfer from the outdoor air to the refrigerant decreases and the efficiency of the heat pump drops significantly, a substantial amount of energy therefore being wasted. Hence, it is necessary to periodically defrost the outdoor coil. For example, this may be accomplished by reversing the refrigerant flow in the heat pump which will heat the outdoor coil and melt the frost.

It is recognized that there is an optimum point of frost accumulation at which the heat pump should be switched to its defrost mode of operation to initiate defrost. If defrost is commanded too soon or too late, energy will be wasted and efficiency will suffer. It has been very difficult to achieve such optimum operation in the past. In one previous system, the differential between the outdoor ambient (dry bulb) temperature and the refrigerant temperature in the outdoor coil is measured. The outdoor coil temperature, which is less than the outdoor ambient temperature, decreases as frost builds up, and this increases the temperature split or difference that exists between the two temperatures. When the temperature split increases to a predetermined value, namely, when the coil temperature becomes lower than the outdoor ambient temperature by a predetermined amount, the outdoor coil is defrosted. This prior temperature differential type defrost control, however, fails to take the prevailing weather conditions into account and cannot adjust to weather changes.

The temperature split between the outdoor ambient air (dry bulb) temperature and the refrigerant temperature in the outdoor coil for clean coil operation (namely, when there is no frost on the coil) is a function of the outdoor wet bulb temperature and not the dry bulb temperature. For example, when the outdoor ambient air has a 35° F. dry bulb temperature, a 34° F. wet bulb temperature, and a relative humidity of about 90%, the refrigerant temperature in the outdoor coil of a typical three ton heat pump may be about 23° F. when the outdoor coil is frost-free, the clean coil temperature split (namely, the outdoor ambient temperature minus the outdoor coil temperature under frost-free conditions) thereby being 35°−23° or 12°. (All temperatures mentioned herein will be F. or Fahrenheit.) For the same outdoor dry bulb temperature, an outdoor wet bulb temperature of 28° and an outdoor relative humidity of about 40% may then provide an outdoor coil temperature of about 17°, resulting in a clean coil temperature split of 35°−17° or 18°. Neither humidity condition is uncommon in most areas. Thus, if the defrost control were set, when the ambient air has a 34° wet bulb temperature, to initiate defrost at a temperature differential of, for example, 5° above its expected clean frost-free coil condition, defrost would occur when the temperature differential became 12°+5° or 17° and dry weather conditions would result in the system continually defrosting itself without time for frost buildup on the outdoor coil.

Even if the temperature split, at which defrost should occur, is properly determined when the outdoor coil is frost-free, long before frost builds up and the temperature split is reached the weather conditions (namely, the outdoor temperature and/or relative humidity) may change significantly, and that previously determined temperature split may no longer be appropriate or valid. If there is a decrease in outdoor temperature between defrost modes, excessive frost would build up on the outdoor coil and defrost should now be initiated at a smaller temperature split, not the one previously determined. On the other hand, as the outdoor temperature rises the same system may go into needless defrost because the control would assume that frost is building up on the coil, when it may not.

This phenomenon may be appreciated and more fully understood by observing FIG. 1 which provides a graph of the performance of the typical three ton heat pump mentioned previously. The graph plots the wet bulb temperature of the outdoor air versus the outdoor ambient or dry bulb temperature at different outdoor relative humidities. The graph shows the liquid line temperature, which is essentially the same as the outdoor coil temperature or the coil surface temperature, under clean coil conditions at various wet bulb temperatures. The clean coil temperature splits (the outdoor dry bulb temperature minus the liquid line temperature) for different weather conditions, namely at different points on the graph, may easily be determined by substraction of one temperature from the other at the point that represents the weather conditions. The graph clearly illustrates that the liquid line temperature is strictly a function of the wet bulb temperature, and thus the moisture in the outdoor air.

It will be assumed that on a given day at about 7:00 a.m. the weather conditions in a particular area are as depicted by point 11 in FIG. 1, namely about 12° outdoor ambient temperature, 10.5° wet bulb temperature and about 77% relative humidity, the liquid line temperature for clean coil conditions thus being about 4.5° to provide a clean coil temperature split of 12°−4.5° or 7.5°. Point 12 indicates the assumed weather conditions on the same day at 10:00 a.m.—29° outdoor dry bulb temperature, 23° wet bulb temperature, about 40% relative humdity and a liquid line temperature of about 13.5°, the clean coil temperature split thereby being 29°−13.5° or 15.5°. This corresponds to an 8° increase (15.5−7.5) in the temperature split for a clean outdoor coil. If the control system were programmed, in accordance with the data at 7:00 a.m., to initiate defrost after there is a 4° temperature increase in the clean coil temperature split, a needless defrost cycle would occur with no frost buildup on the outdoor coil. Points 13 and 14 in FIG. 1 depict the assumed weather conditions at 4:00 p.m. and 11:00 p.m. respectively, on the same given day. The graph indicates that the clean coil temperature split would change downward from about 18° to 11.5°, or about 6.5°, between 4:00 p.m. and 11:00 p.m. Thus, a 4° programmed differential would require that the initial 18° clean coil split at 4:00 p.m. would have to increase to 22° before defrost would occur, whereas the optimum defrost split (the difference between the outdoor temperature and the coil temperature when the defrost mode should be initiated) for the weather conditions at 11:00 p.m. would be 11.5° plus 4° or 15.5°. Hence, the split would increase 6.5° (from 15.5° to 22°) above the optimum defrost condition before defrost would be initiated and excessive frost would accumulate. The conditions assumed in explaining the FIG. 1 graph are not uncommon, since the outdoor temperature and relative humidity may experience wide variations over a 24-hour period.

A defrost control system, whose operation is readjusted and updated as weather conditions change, is disclosed in copending U.S. patent application Ser. No. 619,957, filed June 12, 1984, in the name of James R. Harnish, and assigned to the Assignee of the present invention. In that system the initiation of outdoor coil defrost is timed to occur at the optimum point regardless of changing weather conditions so that defrost only and always occurs when it is necessary, thereby increasing the efficiency of the heat pump, conserving energy and improving system reliability. Any time there is a significant change in the weather conditions, the defrost control system effectively recalculates when a defrost cycle should be initiated.

When the defrost control system disclosed in U.S. patent application Ser. No. 619,957 is powered up, which of course occurs after a power outage, the amount of frost accumulation on the outdoor coil at that time is unknown. There is no previous record of the clean coil conditions and the system does not know the current condition of the coil. A power outage may have occurred when the heat pump was very near the defrost initiation point. On the other extreme, the outdoor coil may have been defrosted just before the power outage. The defrost control system of the present invention is an improvement over that disclosed in patent application Ser. No. 619,957 in that its operation, during the period following system power up, is calculated to optimize efficiency and minimize energy consumption. A starting point is determined by assuming clean coil conditions, namely assuming a value for the coil temperature.

The present defrost control system has another enhancement over the system in patent application Ser. No. 619,957. Under normal operating conditions, the outdoor coil temperature should never drop more than a preset amount, determined by the heat pump design, below the outdoor ambient temperature. The heat pump should have been established in its defrost mode before that occurs. If the coil temperature lowers to the extent that the maximum allowable temperature difference between the outdoor temperature and the coil temperature is exceeded, the system is malfunctioning and a fault condition exists which could damage the heat pump, particularly the compressor. The defrost control system of the present invention provides a safeguard against such a fault condition by defrosting the outdoor coil any time the condition occurs. If two successive default defrosts have been requested within a predetermined time period, such as within one hour, the heat pump's compressor is turned off and locked out.

SUMMARY OF THE INVENTION

The invention provides a defrost control system for a heat pump having a compressor, an indoor coil, and an outdoor coil in thermal communication with outdoor ambient air, the heat pump being switchable from a heating mode to a defrost mode to defrost the outdoor coil. The control system comprises a first temperature sensor for sensing the temperature of the outdoor ambient air, and a second temperature sensor for sensing the temperature of the outdoor coil, the coil temperature being less than the outdoor ambient temperature and decreasing as frost accumulates on the outdoor coil. Control means are provided for determining, from the two sensed temperatures under clean frost-free coil conditions, a Normal Defrost Value, or defrost temperature split, which is the difference that will later exist between the two sensed temperatures under frosted coil conditions when defrosting will be necessary. Defrost means, controlled by the control means, establishes the heat pump in its defrost mode to defrost the outdoor coil when the coil temperature becomes lower than the outdoor ambient temperature by an amount that is greater than the Normal Defrost Value. When the defrost control system is initially powered up, at which time the amount of frost buildup on the coil is unknown, the control means effectively ignores the sensed coil temperature and instead employs the sensed outdoor ambient temperature to calculate an assumed value for the coil temperature which value is likely to exist during clean frost-free conditions, the first Normal Defrost Value determined after power up thereby being based on the assumed coil temperature.

In accordance with another aspect of the invention, the sensed outdoor ambient temperature is also employed to calculate a Default Defrost Value which is the maximum temperature difference that will be allowed between the outdoor ambient temperature and the coil temperature, the control means functioning, in the event that the Default Defrost Value is attained and the coil temperature becomes lower than the outdoor ambient temperature by an amount greater than the Default Defrost Value, to actuate the defrost means and effect defrosting of the outdoor coil. In addition, the control means determines if two successive default defrosts have been requested within a predetermined time period and, if that condition is found, the control means causes the compressor to be turned off and locked out.

DESCRIPTION OF THE DRAWINGS ILLUSTRATING THE INVENTION

The features of the invention which are believed to be novel are set forth with particularity in the appended claims. The invention may best be understood, however, by reference to the following description in conjunction with the accompanying drawings in which:

FIG. 1 is a graph of the performance of a typical three ton heat pump.

FIG. 2 schematically illustrates a heat pump having a defrost control system, for the heat pump's outdoor coil, constructed in accordance with one embodiment of the invention; and, FIG. 3 is a program flow chart illustrating the logic sequence or routine of operations and decisions which occur in operating the defrost control system.

DESCRIPTION OF THE ILLUSTRATED EMBODIMENT

Figure 2:
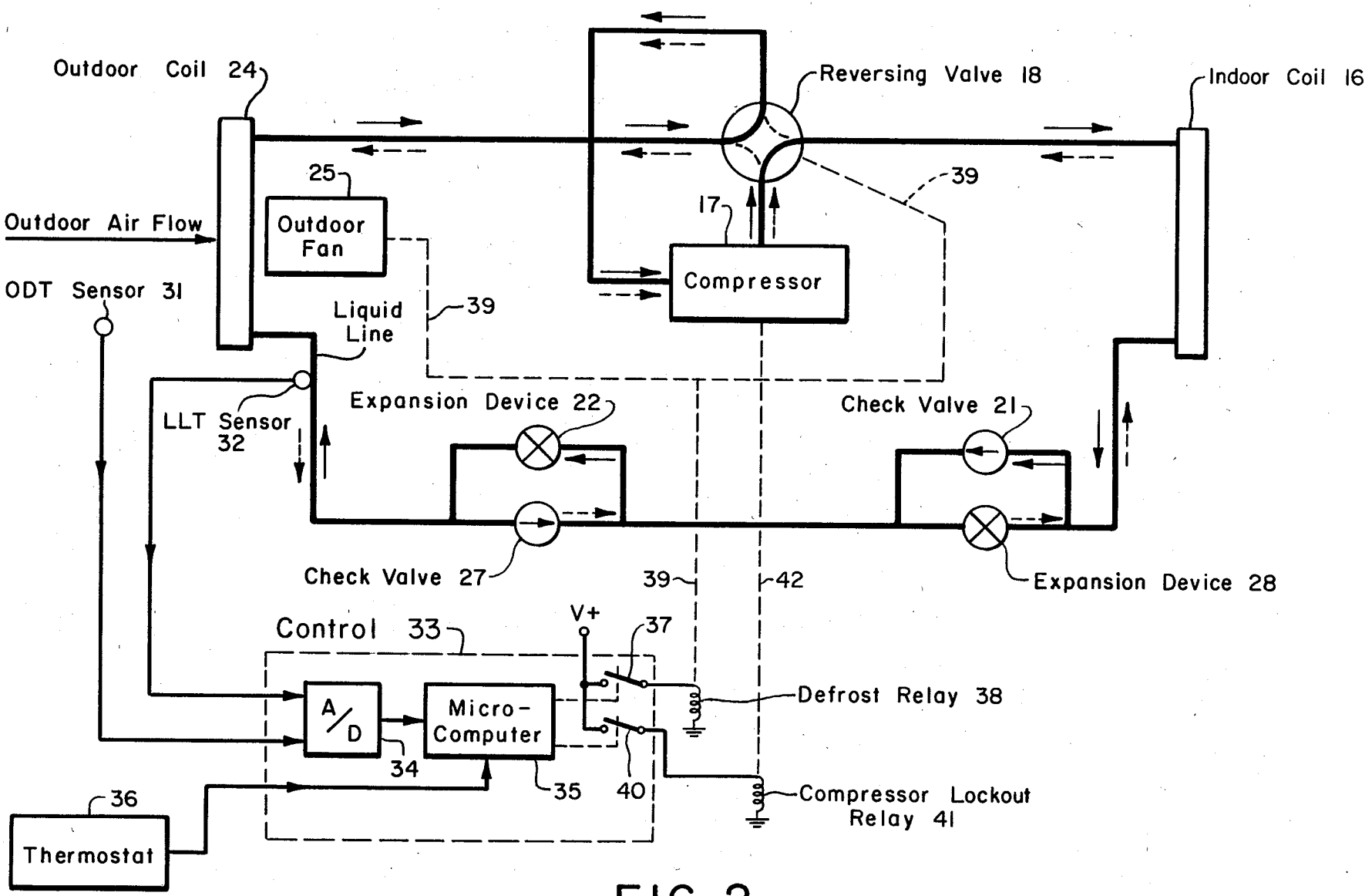

FIG. 2 depicts the major components of a typical heat pump for either heating or cooling an enclosed space as heat is pumped into or abstacted from an indoor coil 16. When the heat pump is in its heating mode, refrigerant flows through the refrigeration circuit in the direction indicated by the solid line arrows. The flow direction reverses when the pump is established in its cooling or air conditioning mode, as illustrated by the dashed line arrows. Refrigerant vapor is compressed in compressor 17 and delivered from its discharge outlet to a reversing valve 18 which, in its solid line position, indicates its heating mode. In that mode, the compressed vapor flows to the indoor coil 16, which functions as a condenser, where the vapor is condensed to reject heat into the enclosed space by circulating room air through the indoor coil by means of an indoor fan (not shown). The liquid refrigerant then flows through check valve 21, which would be in its full flow position, expansion device 22 and the liquid line to the outdoor coil 24 which serves as an evaporator during the heating mode. The refrigerant absorbes heat from the air flowing through the outdoor coil, the outdoor air being pulled through the coil by outdoor fan 25. Anytime the heat pump is in its heating mode, fan 25 will be turned on. After exiting the outdoor coil 24, the refrigerant passes through reversing valve 18 to the suction inlet of compressor 17 to complete the circuit.

In the cooling mode, the reversing valve 18 is moved to its dashed line position so that the refrigerant vapor compressed in compressor 17 flows to the outdoor coil 24 where it condenses to transfer heat to the outdoors. The liquid refrigerant then flows through the liquid line, check valve 27 and expansion device 28 to the indoor coil 16 which now functions as an evaporator. Heat is abstracted from the indoor air, causing the refrigerant to vaporize. The vapor then flows through the reversing valve 18 to the suction inlet of compressor 17.

The components described above are well-known and understood in the art. The present invention is particularly directed to a control system for the heat pump arrangement, especially to a control system whose operation is controlled, in part, by data sensors. To this end, a first temperature sensor 31, which may be a thermistor, is positioned close to the outdoor coil 24 to sense the ambient temperature of the outdoor air or atmosphere. For convenience, it may be called the outdoor temperature or ODT sensor. A second temperature sensor 32, which can also be a thermistor, is positioned immediately adjacent to the liquid line in order to sense the temperature of the refrigerant liquid in the line. Since this liquid line temperature is essentially the same as the refrigerant temperature in the outdoor coil, or coil surface temperature, the liquid line temperature or LLT sensor 32 will monitor the outdoor coil temperature.

Sensors 31 and 32 are coupled to a control 33 which comprises an analog-to-digital converter 34 and a microcomputer 35 which may, for example, take the form of a 6805R2 microcomputer manufactured by Motorola. Such a microcomputer may easily be programmed to perform the logic sequence depicted by the flow chart of FIG. 3. Control 33 also receives an input from the thermostat 36 which controls the operation of the heat pump in conventional fashion. As will be made apparent, the input from thermostat 36 provides the microcomputer 35 with information relative to the operation of the heat pump. The control 33 includes a pair of normally-open contacts 37 which are controlled by the microcomputer 35. When contacts 37 are closed, defrost relay 38 is energized. The dashed construction lines 39 schematically illustrate that the defrost relay 38 controls the positioning of reversing valve 18 and the energization of outdoor fan 25. When the relay is de-energized, the reversing valve and the outdoor fan will be controlled and operated in conventional manner. On the other hand, when relay 38 is energized the heat pump is switched to its defrost mode, reversing valve 18 being moved to its dashed line, or cooling mode, position and outdoor fan 25 being turned off. In this way, the hot refrigerant gas from the compressor 17 will be delivered to the outdoor coil 24 to melt any frost on the coil. By turning fan 25 off, the outdoor air flow across the coil is eliminated, reducing the heat transfer from the coil to the outside air to a very low level. The heat therefore builds up within the coil itself and rapidly defrosts the coil.

Microcomputer 35 also controls another pair of normally-open contacts 40 which in turn control compressor lockout relay 41. When contacts 40 are closed, relay 41 is energized and, as indicated by dashed construction line 42, controls the compressor 17. Specifically, when relay 41 is energized compressor 17 is turned off and locked out in any appropriate manner. For example, when power is supplied to the compressor motor through a contactor, a pair of normally-closed contacts, which are opened when relay 41 energizes, may be inserted in series with the contactor. Preferably, once the normally-closed contacts are opened, and the compressor is turned off, a manual reset will be needed to reset those contacts to their normal position. In this way, compressor 17 will be locked out even if relay 41 becomes de-energized.

Figure 3:
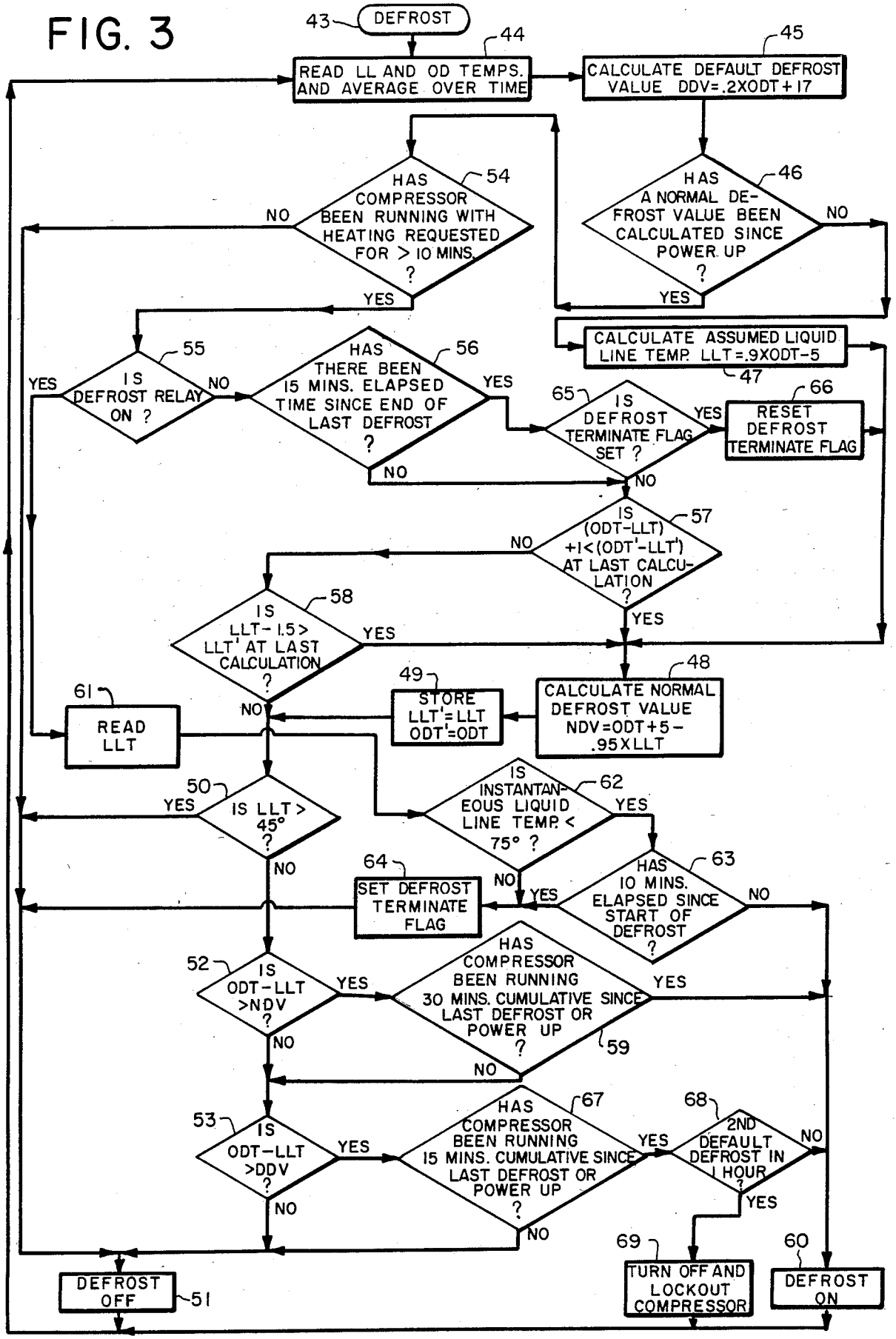

In short, microcomputer 35 will be operated, in accordance with the logic sequence of FIG. 3, in order to precisely time the opening and closing of contacts 37 in response to the assumed starting conditions, in response to the prevailing weather conditions, and in response to a fault condition so that defrost occurs only when it is necessary, thereby precluding needless defrost or excessive frost buildup and preventing damage to the heat pump. In addition, contacts 40 will be closed when two successive default defrosts have been requested within one hour.

Consideration will now be given to an explanation of the operation of the defrost control system. Referring to FIG. 3, the oval, labeled "Defrost" and identified by the reference number 43, indicates the entry point into the logic flow chart or into the routine. This is the point where entry must be made in order to eventually determine whether defrost should occur and whether the compressor should be turned off. In accordance with operation or instruction block 44 the computer will initially read the liquid line (LL) and outdoor ambient (OD) temperatures and average or integrate those temperatures over a period of time, preferably about one minute. This step removes any short term fluctuations in the temperatures. Thus, this eliminates the effects of wind gusts that may give momentary changes. The liquid line temperature (LLT) and the outdoor temperature (ODT) will be continuously averaged over a minute so that any time the temperatures LLT and ODT are used in the logic sequence (with the exception of one operation and one decision that will be explained), the temperatures will be average temperatures.

In accordance with instruction block 45, the Default Defrost Value (DDV), which is the maximum temperature difference that will be allowed between the outdoor temperature (ODT) and the liquid line temperature (LLT) to avoid damage to the heat pump, is calculated based on the current or present outdoor temperature. It has been found empirically that the Default Defrost Value may be determined by multiplying the ODT by a constant and then adding another constant to the product. For the particular three ton heat pump mentioned previously, it has been determined that by multiplying the ODT by 0.2, and then adding 17, the DDV may be calculated, as indicated by the equation within block 45 in FIG. 3. Note that the calculation is always based on the current outdoor temperature so any time that temperature changes the calculated DDV will likewise change. Hence, the DDV is continuously updated.

After the Default Defrost Value has been calculated, decision block 46 will be entered to inquire whether a Normal Defrost Value or NDV has been calculated since power up. Preferably, the microcomputer 35 is continuously powered at all times, even when thermostat 36 is not calling for heat and the heat pump is inoperative. Power up would include not only when the control system is initially turned on but also after every power outage including brown-outs and momentary power interruptions. Any time there is a power loss, either purposely or accidentally, any stored information in the memory banks of the microcomputer will be lost or erased.

During normal running conditions the Normal Defrost Value is calculated under known clean coil conditions (namely, when it is known that there is no frost buildup on outdoor coil 24) from the current liquid line and outdoor temperatures and this NDV is the temperature split that will later occur between those two temperatures under frosted coil conditions when defrosting will become necessary. As indicated previously, the liquid line temperature decreases as frost accumulates on the coil and thus the temperature split normally increases as frost builds up. When the control system is powered up, it is not known whether clean frost-free conditions exist. Hence, at power up a calculation based on the current liquid line temperature could provide a grossly inaccurate Normal Defrost Value and result in a defrost either long before or long after it is actually needed. Of course, the microcomputer could be programmed to always defrost the outdoor coil after every system power up, but this would be a significant waste of energy. Instead, and in accordance with a salient feature of the invention, when the defrost control system is initially powered up the current outdoor ambient temperature is employed to calculate an assumed value for the liquid line temperature, which value is likely to exist during clean frost-free conditions and assuming an average outdoor relative humidity. In other words, by using the ODT it is possible to determine what the LLT would probably be if the outdoor coil were frost-free.

Figure 1:
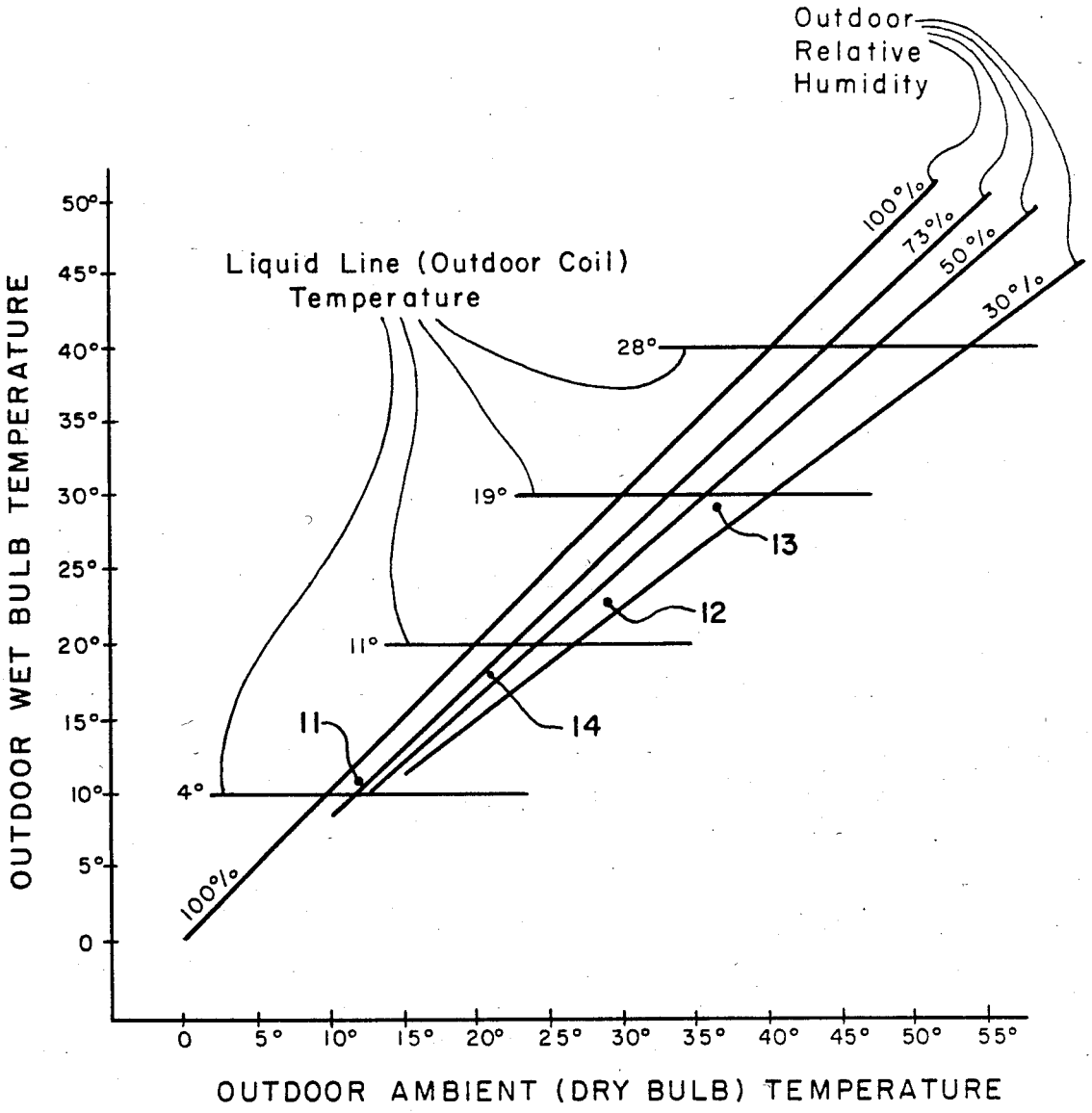

Since a Normal Defrost Value has not been calculated since power up, instruction block 47 will be entered and will calculate the assumed value for the liquid line temperature in accordance with the indicated equation $LLT=0.9\times ODT-5$, which equation was determined empirically. The specific constants (0.9 and 5) are customized for the three ton heat pump under consideration. After calculation of the assumed LLT by block 47, instruction block 48 will be entered to determine the first Normal Defrost Value or NDV after power up in accordance with the equation $NDV=ODT+5-0.95\times LLT$. This equation was also determined empirically for the particular three ton unit considered. Thus, the constants of the equation may vary depending on unit design. It was found that for any weather condition when the temperature split or difference (ODT minus LLT) at clean coil conditions, increases to the NDV as frost accumulates (remembering that the LLT decreases as frost builds up) at that optimum point sufficient frost will exist to require defrosting. In other words, when the LLT becomes lower than the ODT by the NDV, the outdoor coil should be defrosted. Defrosting before or after that optimum point is reached would be inefficient and wasteful of energy. For example, if the LLT is 10° and the ODT is 25° when the coil is frost-free, the clean coil temperature split will be 15° for the heat pump whose performance curves are shown in FIG. 1. If a NDV is calculated, based on those clean coil conditions, the NDV will equal $25+5-0.95$ (10) or 20.5°. This means that at a later time, after frost has accumulated on the outdoor coil and defrosting is needed, the temperature split between ODT and LLT will be 20.5°. If the ODT does not change during that time, the LLT, when the defrost temperature split is reached, will be $25°-20.5°$ or 4.5°.

After the Normal Defrost Value is determined, the LLT and ODT used in the calculation will be stored, as indicated by operation block 49, as LLT′ and ODT′. Decision or inquiry block 50 is then entered to determine if the present or current LLT is greater than 45°. If the LLT is above that temperature level, defrosting will not be needed and operation block 51 will be entered which thereupon issues a defrost off instruction for effectively maintaining contacts 37 open so that defrosting will not occur.

If it is found (inquiry block 50) that the LLT is below 45°, then a decision is made in block 52 as to whether ODT−LLT (the current outdoor temperature minus the current liquid line temperature) is greater than the NDV that was previously calculated. Assuming that the LLT has not dropped below the ODT by an amount greater than the NDV, the answer from inquiry block 52 will be NO and block 53 then determines if the ODT−LLT temperature difference is greater than the Default Defrost Value. Of course, under normal operating conditions the NDV is less than the DDV and if the NDV is not exceeded the DDV will likewise not be exceeded. The NO exit of inquiry block 53 will thus be followed to block 51 and a defrost off instruction will be produced.

After the first Normal Defrost Value is calculated, based on the current outdoor temperature and the assumed liquid line temperature, the YES exit of block 46 is taken and decision block 54 is entered to inquire whether the compressor 17 has been running with heating being requested for at least a preset time period, for example, for at least ten minutes following system power up. The determination made by decision block 54 is accomplished by sensing the input to the microcomputer 35 from thermostat 36 which will indicate whether the thermostat has been calling for heat, and the compressor has been operating, for at least ten minutes. Assuming that the compressor starts operating as soon as the control system powers up, since the control system has just powered up the NO exit of block 54 will be taken and operation block 51 will be entered which thereupon issues a defrost off instruction for effectively maintaining contacts 37 open so that defrosting will not occur. Of course, when contacts 37 are already open, a defrost off instruction is redundant. After a defrost off instruction is issued, the routine is exited and re-entered at block 44 to start another logic sequence. Thus, during the first ten minutes of compressor operation after the control system has been powered up, the routine will continue to cycle through the logic sequence comprising only blocks 44, 45, 46, 54 and 51. In this connection, note that the control system always calculates the Default Defrost Value by means of block 45. Hence, the DDV is effectively recalculated any time there is a change in the sensed outdoor ambient temperature, thereby continuously updating the DDV.

At the end of the ten minute interval, the YES exit of block 54 will be followed and decision block 55 will be entered to inquire whether defrost relay 38 is on or energized, namely, whether the heat pump is already in the defrost mode. This logic step is needed during defrost, as will be explained later. In effect, block 55 determines whether the system is already in the defrost mode. During defrosting, the microcomputer continuously cycles through its routine and, if thermostat 36 continuously calls for heat, blocks 46 and 54 will continue issuing YES answers throughout the defrost mode as well as the heating mode.

Since the defrost relay will be off, decision block 56 will be entered, from the NO exit of block 55, to determine if there has been at least fifteen minutes of elapsed time since the end of the last defrost. As will be made apparent later, block 56 allows the LLT to stabilize before another NDV calculation is made. At this time the control system will show no previous defrost, since at power up there is no stored information or history relative to a previous defrost. Hence, the NO exit of inquiry block 56 will be taken to the block 57 which effectively decides whether the present temperature difference between the outdoor temperature and the liquid line temperature plus 1° is less than the old difference at the calculation time. Block 57 inquires whether the ODT minus the LLT plus 1° is smaller than the ODT′ minus the LLT′, ODT′ and LLT′ being the values of the outdoor and liquid line temperature used in calculating the current NDV and stored at the time of calculation. In this way, block 57 determines if the current ODT−LLT temperature split is decreasing by at least 1° from when the NDV was calculated. The inclusion of block 57 in the routine compensates for a change in weather conditions where the outdoor temperature is decreasing.

Since the control system has only been operating about ten minutes since power up, weather conditions probably have not changed sufficiently to produce a YES in block 57, so the NO exit of that block will be taken to block 58 which determines if the present liquid line temperature has increased by at least 1.5° from the assumed liquid line temperature stored at the calculation of the NDV. An increasing LLT indicates that weather conditions have changed, since normally as frost builds up on the outdoor coil the LLT decreases. By detecting a significant increase in the LLT, the control system will compensate for an increase in the outdoor wet bulb temperature. Once again, inasmuch as the system has been functioning only about ten minutes following power up, the weather conditions probably have not changed enough to result in a YES answer from block 58, the NO exit thus being taken to block 50. From that block, blocks 52 and 53 are followed to the defrost off block 51. Hence, during this period following power up the routine will continue to cycle through the logic sequence comprising only blocks 44, 45, 46, 54, 55, 56, 57, 58, 50, 52, 53 and 51.

Assume now that the prevailing weather conditions are relatively constant and that the heat pump has been operating for a relatively long period. During this time NO answers will be issued by blocks 57 and 58 indicating that there is no reason to recalculate the NDV and the NDV determined after power up, based on the assumed liquid line temperature, will continue to be effective. Assume also that during this long time period sufficient frost has built up on the outdoor coil 24 to cause the liquid line temperature to drop to the extent that the current temperature split between the ODT and the LLT exceeds the Normal Defrost Value previously calculated. As a consequence, when the routine enters block 52 a YES answer will now be issued for the first time and this causes decision block 59 to determine whether the compressor has been running for at least 30 minutes cumulative since the last defrost or since power up. This is total accumulated running time, not including interruptions. In other words, the operation of the compressor does not have to be continuous. Only when the on-times of the compressor add up to 30 minutes will block 59 issue a YES answer. Block 59 ensures that defrost cannot occur more than once every 30 minutes. Under normal operating conditions defrost should not occur for at least 30 minutes.

Assuming that compressor 17 has been functioning for a cumulative time of at least 30 minutes, the YES exit of block 59 will be followed to operation block 60 to close contacts 37 and energize defrost relay 38. Reversing valve 18 will thereupon be operated to reverse the refrigerant flow between coils 16 and 24 and to establish the heat pump in its defrost mode, the coils thus being reversed in temperature. At the same time, outdoor fan 25 is turned off to concentrate the heat at the service of outdoor coil 24 to rapidly melt the frost thereon. Since the indoor air will be cooled by coil 16 during the defrost mode of operation, a heater of some type (for example, an electric heater) may be turned on to warm the indoor air while the outdoor coil is being defrosted. To this end, defrost relay 38 may also control a set of contacts for energizing the heater. Alternatively, a separate relay, controlled by contacts 37, may be provided for controlling the heater.

While the heat pump is in its defrost mode, the microcomputer 35 continues to cycle through its program. At this time, however, decision block 55 will issue a YES answer and instruction block 61 will read the current instantaneous liquid line temperature. This is the only step in the logic sequence where the instantaneous liquid line temperature is used. In every other instance, the LLT is the current temperature averaged over one minute. The instantaneous LLT is needed because the temperature, along with the head pressure in the outdoor coil, rise very rapidly at the end of the defrost cycle and unless the temperature is monitored very closely and limited, the head pressure could exceed the level at which the compressor's high pressure cut off would open and the compressor would be turned off, thus shutting down the heat pump. Decision block 62 then responds to the present instantaneous liquid line temperature and if it is greater than 75° the NO exit of block 62 will be used, a defrost terminate flag will be set (block 64), and the defrost relay 38 will be turned off through block 51 to terminate defrost. When the LLT reaches 75° the outdoor coil 24 will have been defrosted. Even if the outdoor ambient temperature is extremely cold, for example 5°, the outdoor coil temperature will still increase to 75° because there is no air flow over the outdoor coil at that time and heat will be built up within the coil itself. At 75°, the frost is quickly removed.

If during defrost block 62 finds that the instantaneous LLT is below 75°, defrost continues and the YES exit of that block is followed to decision block 63, which determines if ten minutes has elapsed since defrost started. If not, defrost continues, but if the answer is YES, defrost is terminated and the defrost terminate flag is set in block 64. Defrost will not be allowed to occur for more than ten minutes. If the LLT does not go to 75° in ten minutes, the wind is probably blowing so hard across the outdoor coil that the wind functions like a fan and keeps the LLT from rising to 75°. In any event, however, adequate defrosting will occur in ten minutes even though the 75° temperature is not attained.

After defrost is terminated and the heat pump is switched back to its heating mode, for the next fifteen minutes the microcomputer will cycle through the routine comprising blocks 44, 45, 46, 54, 55, 56, 57, 58, 50, 52, 53 and 51, assuming, of course, that the weather conditions have not changed since the NDV was calculated previous to the defrost. Until a new NDV is calculated, the old one will not be erased and will still be effective even though a defrost has occurred. In other words, once an initial NDV has been calculated after power up, there will always be a NDV stored in the control sytem. The stored NDV is not erased until a new NDV is calculated. Fifteen minutes of waiting time was selected because that amount of time may be required to stabilize the conditions after the termination of defrost. It may take that long for the indoor and outdoor coil temperatures to reach stable conditions. Since the coils are reversed in temperature during the defrost mode, it takes a substantial period of time to revert the coils back to their original temperatures after defrost is concluded. Minimum frost will accumulate on the outdoor coil during that fifteen minute interval so clean coil conditions will exist at the end of the interval.

After fifteen minutes has elapsed since the end of the defrost, the routine will change and the YES exit of block 56 will be used. Decision block 65 will thus be entered for the first time since power up in order to determine whether a NDV has been calculated since the last defrost by checking to see if the defrost terminate flag had been set by block 64. Block 65 is included in the program to ensure that a NDV will be calculated fifteen minutes after defrost and under clean outdoor coil conditions. Since the defrost terminate flag is set, the YES exit of block 65 will be taken to block 66, to reset the defrost terminate flag, and to block 48 to initiate the calculation of a new NDV under known clean coil conditions and based on the weather conditions prevailing at the time of the calculation, those weather conditions being reflected by the current LLT and ODT. Acording to block 49, the LLT and ODT used in calculating the new NDV will be stored as LLT′ and ODT′, respectively, for later use.

The new NDV has now been established, when it is known that the outdoor coil is frost-free, and until there is a substantial weather change the microcomputer will cycle through the routine comprising blocks 44, 45, 46, 54, 55, 56, 65, 57, 58, 50, 52, 53 and 51. Assume now that before sufficient frost accumulates on coil 24 to cause the NDV to be reached, there is a significant change in the weather conditions, such as a decrease in the outdoor wet bulb temperature such that the current temperature split between ODT and LLT decreases by at least 1° from the temperature split (ODT′−LLT′) that existed at the time the calculation of the NDV was made. In this event, block 57 will answer YES when it is interrogated and this causes block 48 to recalculate the NDV based on the ODT and LLT prevailing at that time. The new NDV will essentially eliminate the problem of excessive frost buildup on the outdoor coil when the change in weather conditions results in a defrost temperature split smaller than what was determined after the last defrost cycle. In other words, if the NDV was not recalculated and the control system waited for the old NDV to be reached, by that time excessive frost would have accumulated on the outdoor coil.

On the other hand, if the changing weather conditions (increasing outdoor wet bulb temperature) cause the LLT to increase by at least 1.5° from its value when the NDV was calculated, the YES exit of block 58 will be taken to block 48 to initiate a recalculation of the NDV based on the new weather conditions. A new NDV thus results, overcoming the problem of needles defrost cycles when no frost has accumulated on the outdoor coil, which problem could otherwise occur when changing weather conditions cause a larger defrost temperature split than what was calculated after the last defrost. If the NDV was not recalculated and defrost occurred as soon as the old NDV was reached, there would be either no frost or insufficient frost on the outdoor coil to warrant defrost. Hence, the NDV is effectively updated and adjusted between defrost modes as weather conditions vary so that defrost will occur only and always when it is needed, the efficiency of the heat pump thereby being optimized.

As mentioned, under normal operating conditions the Normal Defrost Value will always be less than the Default Defrost Value and when defrost is required it will be initiated by block 52 in the routine. Under some abnormal or fault conditions, the calculated NDV may be greater than the DDV, in which case the DDV must then control the defrost initiation point in order to prevent the LLT from dropping below the ODT to such an extent that the maximum difference allowed between those two temperatures is exceeded. As an example of one fault condition, the outdoor coil could be blocked (such as by leaves) and insufficient air would flow across the coil. As a result, the LLT would be unusually low and a NDV, based on that low LLT, would be very high and could be greater than the DDV. If so it is important that the DDV take over control to preclude damage to the heat pump.

In accordance with a salient feature of the invention, if the NDV is greater than the DDV and the DDV is exceeded by the temperature differential between the ODT and the LLT, the NO exit of block 52 will be taken to block 53 which determines that the DDV has in fact been exceeded. Hence, decision block 67 is entered to inquire whether fifteen minutes of cumulative running time of the compressor has occurred since power up or since the last defrost. If not, a defrost off command will be issued. However, if the answer is YES defrost will be initiated through block 68. If two successive default defrosts are requested within one hour, the YES exit of block 68 will be followed to operation block 69 which effects closing of contats 40 and, consequently, energization of compressor lockout relay 41. As a result, compressor 17 will be turned off and locked out. Hence, the compressor will be shut down even though the thermostat is calling for heat. The fault or abnormal condition could then be corrected before the heat pump is returned to normal operation.

Although the outdoor coil temperature, or liquid line temperature, is used to determine when defrost should be initiated, any temperature related to the coil temperature could be used instead. For example, the temperature of the air leaving the outdoor coil 24 could be used since it is a function of the coil temperature. The same results would be achieved. As in the case of the liquid line temperature, the leaving air temperature will be lower than the outdoor ambient temperature, and as frost builds up on the outdoor coil the leaving air temperature will decrease because the air flow will be restricted by the frost. This provides the same type of indication when defrost should be initiated as is obtained when the LLT is measured. Thus, the air temperature range in the outdoor coil (namely, the temperature split or difference between the outdoor temperature and the temperature of the air after it has passed through the outdoor coil) could be used to determine when a defrost cycle should be initiated. Of course, a slightly different equation than that used in the illustrated embodiment for calculating the Normal Defrost Value would be needed, although the equation form would be the same and only the constants in the equation would have to be changed.

To explain further, fifteen minutes after the termination of defrost and under clean coil conditions the temperature range through the outdoor coil may, for example, be 6°. This temperature range would be stored in a memory bank and whenever the temperature range climbed to, for example, 9° (which would be the Normal Defrost Value) defrost would be commanded. The same concept, for updating the NDV, could be employed to correct for changes in weather conditions. In other words, for a drop in outdoor ambient temperature, a reduced temperature range would replace that previously stored in the memory bank. For an increase in outdoor temperature an increased temperature range would replace the one originally stored. At system power up, an assumed value for the leaving air temperature may be determined in the manner described previously, the constants of the equation being different. Of course, the constants in the equation for determining the Default Defrost Value would also differ.

It should also be recognized that while the illustrated defrost control is microcomputer based, the invention could be implemented instead with other integrated circuits or even with discrete components.

The invention provides, therefore, a unique and relatively inexpensive temperature differential defrost initiation control for the outdoor coil of a heat pump wherein the stabilized clean coil temperature differential between the outdoor ambient temperature and the coil temperature, after defrost, is used to establish a defrost temperature split between those two temperatures, or Normal Defrost Value, at which defrost will later become necessary. If the weather conditions do not vary while the heat pump is operating and frost is building up on the outdoor coil, the Normal Defrost Value will remain constant until it is reached and a defrost cycle is initiated. On the other hand, however, if the outdoor temperature and/or outdoor relative humidity change, those changing weather conditions will be detected and a new Normal Defrost Value will be calculated based on the new weather conditions, as a result of which defrost occurs precisely when it is necessary. When the system is initially powered up, at which time the frost condition of the outdoor coil is unknown, the first Normal Defrost Value is calculated based on an assumed value for the coil temperature. To preclude damage to the heat pump, whenever the outdoor temperature and the coil temperature separate by a maximum allowable amount, namely by the Default Defrost Value, the outdoor coil will be defrosted.

While a particular embodiment of the invention has been shown and described, modifications may be made, and it is intended in the appended claims to cover all such modifications as may fall within the true spirit and scope of the invention.

We claim:

1. In a heat pump having a compressor, an indoor coil, and an outdoor coil in thermal communication with outdoor ambient air, and which heat pump may be switched from a heating mode to a defrost mode to defrost the outdoor coil, a defrost control system for the outdoor coil comprising:

a first temperature sensor for sensing the outdoor ambient temperature;

a second temperature sensor for sensing a second temperature which is related to the temperature of the outdoor coil and which is less than the outdoor ambient temperature, the second temperature decreasing as frost accumulates on the outdoor coil;

control means responsive to the two sensed temperatures, under clean frost-free coil conditions, for determining a Normal Defrost Value which is the difference that will later exist between the two sensed temperatures under frosted coil conditions when defrosting will be required;

and defrost means, controlled by said control means, for establishing the heat pump in its defrost mode to defrost the outdoor coil when the second temperature becomes lower than the outdoor ambient temperature by an amount that is greater than the Normal Defrost Value;

said control means effectively ignoring the sensed second temperature, when the defrost control system is initially powered up at which time the amount of frost buildup on the coil is unknown, and employing the sensed outdoor ambient temperature to calculate an assumed value for the second temperature which value is likely to exist during clean frost-free conditions, the first Normal Defrost Value determined after power up thereby being based on the assumed second temperature.

2. A defrost control system according to claim 1 wherein said control means functions, after a Normal Defrost Value has been determined but before defrosting occurs, to recalculate the Normal Defrost Value any time there is a predetermined change in the sensed temperatures, which will be the result of changes in weather conditions, thereby effectively updating and adjusting the Normal Defrost Value between defrost modes as weather conditions vary so that defrost will occur only and always when it is needed and the efficiency of the heat pump will be optimized.

3. A defrost control system according to claim 1 wherein the assumed value for the second temperature at power up is calculated by multiplying the sensed outdoor ambient temperature by a constant to produce a product from which another constant is then subtracted.

4. A defrost control system according to claim 1 for use in a heat pump where the refrigerant flows, during the heating mode, to the outdoor coil through the heat pump's liquid line, said second temperature sensor sensing the refrigerant temperature in the liquid line so that said second temperature is the liquid line temperature and is essentially the same as the outdoor coil temperature.

5. A defrost control system according to claim 1 wherein the sensed outdoor ambient temperature is employed to calculate a Default Defrost Value which is the maximum temperature difference that will be allowed between the outdoor ambient temperature and the sensed second temperature, said control means functioning, in the event that the Default Defrost Value is attained and the second temperature becomes lower than the outdoor ambient temperature by an amount greater than the Default Defrost Value, to actuate said defrost means and effect defrosting of the outdoor coil.

6. A defrost control system according to claim 5 wherein said control means recalculates the Default Defrost Value any time there is a change in the sensed outdoor ambient temperature, thereby continuously updating the Default Defrost Value.

7. A defrost control system according to claim 5 wherein the Default Defrost Value is calculated by multiplying the sensed outdoor ambient temperature by a constant to produce a product to which is then added another constant.

8. A defrost control system according to claim 5 wherein said control means establishes the heat pump in its defrost mode when the Default Defrost Value is exceeded after the compressor has been running for a preset time interval cumulative since the last defrost or since power up.

9. A defrost control system according to claim 5 wherein said control means determines if two successive default defrosts have been requested within a predetermined time period, and, if that condition is found, the control means causes the compressor to be turned off and locked out.

* * * * *